US006595098B1

(12) United States Patent
Wray

(10) Patent No.: US 6,595,098 B1
(45) Date of Patent: Jul. 22, 2003

(54) MISSILE LAUNCH ASSEMBLY

(75) Inventor: Michael D. Wray, East Greenwich, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/214,484

(22) Filed: Aug. 5, 2002

(51) Int. Cl.[7] ..... F41F 3/04
(52) U.S. Cl. ..... 89/1.809; 114/319
(58) Field of Search ..... 89/1.809; 114/317, 114/318, 319, 238

(56) References Cited

U.S. PATENT DOCUMENTS 5,200,572 A * 4/1993 Bissonette et al. ..... 89/1.81
5,231,241 A * 7/1993 Bissonnette ..... 89/1.81
5,410,978 A * 5/1995 Waclawik et al. ..... 114/238
5,438,948 A * 8/1995 Moody ..... 114/319
6,053,157 A * 4/2000 Frank ..... 124/70
6,216,626 B1 * 4/2001 Curtis ..... 114/238
6,401,645 B1 * 6/2002 Ansay et al. ..... 114/238
6,502,528 B1 * 1/2003 MacLeod et al. ..... 114/319

* cited by examiner

*Primary Examiner*—Charles T. Jordan
*Assistant Examiner*—Jordan Lofdahl
(74) *Attorney, Agent, or Firm*—James M. Kasischke; Michael F. Oglo; Jean-Paul A. Nasser

(57) ABSTRACT

A missile launch assembly for underwater vehicles includes a launch tank having mounted therein an expandable elastomeric disc and a turbine, a water inlet conduit, an impulse tank interconnecting the water inlet conduit and a missile launch tube, and a pump inducer mounted in the water inlet conduit and drivable by the turbine. Movement of the disc from an expanded to a non-expanded condition causes water in the launch tank to drive the turbine to drive the pump inducer to pump water from the water inlet conduit to the impulse tank and thence to the launch tube to effect launch of a missile therein.

13 Claims, 1 Drawing Sheet

MISSILE LAUNCH ASSEMBLY

STATEMENT OF GOVERNMENT INTEREST

The invention described herein may be manufactured and used by and for the Government of the United States of America for Governmental purposes without the payment of any royalties thereon or therefor.

CROSS REFERENCE TO OTHER PATENT APPLICATIONS

Not applicable.

BACKGROUND OF THE INVENTION (1) Field of the Invention

The invention relates to missile launch assemblies and is directed more particularly to an elastomeric powered assembly for launching missiles, such as torpedoes.

(2) Description of the Prior Art

High impulse, short duration fluid pumps are known in the art and are used in submarine torpedo launch systems. Usually, such pump systems require high power piston or turbine machinery to provide the required high velocity fluid flow in a very short time. An attractive alternative to high-powered machines are relatively simple elastic bulbs which expand to contain a volume of fluid, such as sea water, under pressure. Upon release of the water, the bulb quickly returns to its non-expanded state, propelling the water at a high velocity into and through a torpedo tube to effect launch of a torpedo, or other missile, therein.

Elastomeric expandable impulse energy storage and transfer systems are shown and described in U.S. Pat. Nos. 4,848,210, issued Jul. 18, 1989, in the name of Laurent C. Bissonnette, and 5,200,572, issued Apr. 6, 1993 in the names of Laurent C. Bissonnette et al.

In the '210 patent there is disclosed a bladder device for storing potential energy when distended and rapidly converting that stored energy into kinetic energy of a working fluid, for quietly ejecting a projectile from a launch system into a surrounding fluid medium. In the '572 patent there is disclosed an elastomeric impulse energy storage and transfer system including an accumulator body of elastomeric material, the body having an opening at a base portion thereof, and having in elevation an ellipsoidal configuration. The body receives and discharges fluid through the opening and is expandable and contractible in response to receiving and discharging, respectively, the fluid. The body retains the ellipsoidal configuration when in an expanded condition. A submarine projectile launch system includes the accumulator body as a component thereof.

An innate difficulty in structuring such pump and storage devices is in the provision of an elastomeric bulb adapted to contain a large volume of relatively incompressible liquid at pressure sufficiently high to propel the liquid at a high velocity.

Typically, when a disc is used in such a system, a very large rubber disk is mounted in a free flood area of a submarine in such a configuration that one side of the rubber disk is open to sea while the other side is ported to breech ends of the submarine's torpedo tubes. When water is pumped between the disk and torpedo tube, the rubber disk inflates. Water continues to be pumped in this area until the displacement of the disk is approximately equal to the volume of a missile, or other device, in the torpedo tube.

When a valve is opened at the breech end of the tube, the pressurized water ejects the device out of the tube while the elastomer returns to its unstretched configuration. This type of system is very effective in effecting a quiet launch, as the only noise associated with the launch are vibrations initiated by the ejection water traveling through the launch system. However, the volume of water required to effect this type launch is quite large as the shot of water must approximate the volume of the device being launched. The volume requirement can require that the underwater vehicle be larger than desired. This, in turn, results in a substantial cost increase.

Accordingly, there is a need for an expandable energy storage device and fluid pump which provides reliability and durability, which operates quietly, and which provides the required volume of fluid but with a relatively small elastomeric, energy-storing member.

SUMMARY OF THE INVENTION

An object of the invention is, therefore, to provide an expandable pump and energy storage device which is reliable and durable, which operates quietly, and which, though of limited size, provides the necessary volume of fluid to propel a missile of torpedo size from a launch tube.

With the above and other objects in view, as will hereinafter appear, a feature of the present invention is the provision of a launch assembly for underwater vehicles, the assembly comprising a launch tank having mounted therein is an expandable elastomeric disc and a turbine. The assembly further includes a water inlet conduit, an impulse tank interconnecting the water inlet conduit and a missile launch tube, and a pump inducer mounted in the water inlet conduit and drivable by the turbine. Movement of the disc from an expanded to a non-expanded condition causes water in the launch tank to drive the turbine to drive the pump inducer to pump water from the water inlet conduit to the impulse tank and thence to the launch tube to effect launch of a missile therein.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention, from which its novel features and advantages will be apparent, and wherein.

DESCRIPTION OF THE PREFERRED EMBODIMENT

Figure 1:
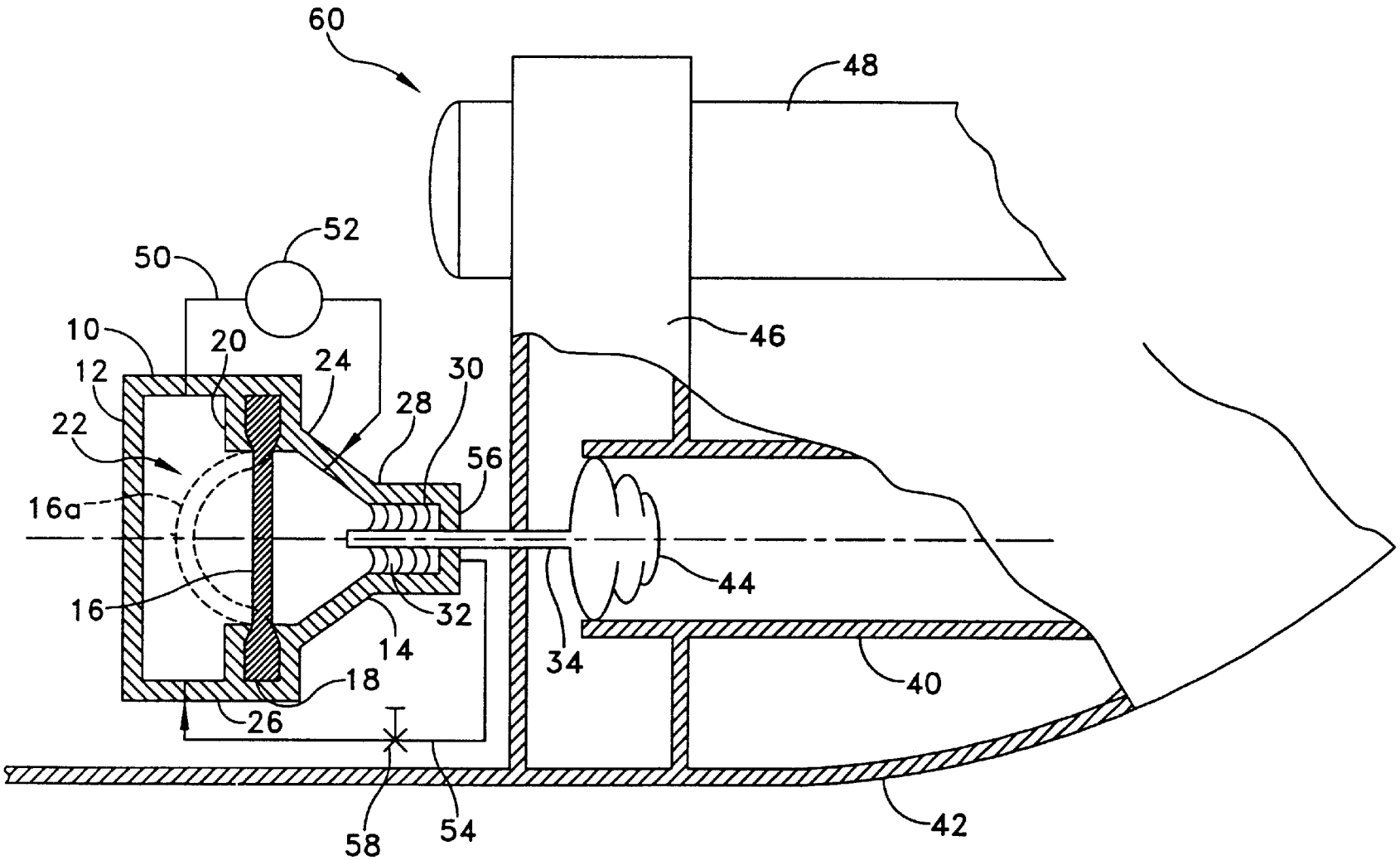
FIG. 1 is a diagrammatic illustration of one form of a missile launch assembly illustrative of an embodiment of the invention.

Referring to FIG. 1, it will be seen that the illustrative missile launch assembly includes a launch tank 10 having a body portion 12 and a neck portion 14. An elastomeric disc 16 is fixed at a periphery 18 thereof to an internal wall structure 20 of the launch tank body portion 12. The disc 16 and body portion 12 define a chamber 22. The disc 16, which forms one wall of the chamber 22, is disposed between the remainder of the launch tank 10 and the neck portion 14.

The launch tank neck portion 14 includes a funnel portion 24 contiguous with walls 26 of the chamber 22, and a cylindrically-shaped portion 28 extending outwardly from the funnel portion 24. A turbine 30, including turbine blades 32 fixed on a turbine shaft 34, is disposed in the cylindrically-shaped portion 28.

A water inlet conduit 40 is disposed in a vessel 42 supporting the missile launch assembly and is in communication with the water environment outside of the vessel, typically sea water. A pump inducer 44 is mounted on the turbine shaft 34 and is disposed in the water inlet conduit 40.

An impulse tank 46 is in communication with the water inlet conduit 40 and one or more missile launch tubes 48.

A charge conduit 50 extends from the launch tank chamber 22 to the launch tank funnel portion 24. A charge pump 52 is mounted in the conduit 50 and is operative to pump water from the chamber 22 to the neck portions 14.

A transfer conduit 54 interconnects an end 56 of the launch tank cylindrically-shaped portion 28 and the launch tank chamber 22. A launch valve 58 is mounted in the transfer conduit 54 for selectively placing the launch tank end portion 56 in communication with the launch tank chamber.

In operation, the water inlet conduit 40, the impulse tank 46, and a breech end 60 of a missile launch tube 48, such as a torpedo tube, are flooded with seawater introduced by way of the water inlet conduit 40. Activation of the charge pump 52 in preparation for a launch moves water from the chamber 22 and into the neck portion 14 of the launch tank 10. The valve 58 remains closed.

As water pressure in the neck portion 14 of launch tank 10 increases by virtue of increasing water from conduit 50, and pressure in chamber 22 decreases by virtue of water outgoing through the conduit 50, the disc 16 expands into the chamber 22, as represented at 16*a* in FIG. 1.

When it is desired to launch, or "fire" a torpedo or other underwater vehicle, the launch valve 58 is opened, permitting pressure in the neck portion 14 of launch tank 10 to decrease. The disc immediately returns to its non-expanded shape, forcing a small shot of high-pressure water, contained in the launch tank funnel portion 24, through the turbine 30, which turns the turbine shaft 34 and the pump inducer 44 at a high rate of speed. The pump inducer 44 forces a large shot of pressurized water through the impulse tank 46 and into the launch tube breech end 60, driving a missile from the missile tube 48.

Upon completion of a launch, the launch valve 58 is closed and the charge pump 52 can be energized to prepare for another launch.

In view of the minimal number of moving parts, the assembly provides the required durability and reliability. In view of the relatively noiseless expansion and deflation of the elastomer disc, the assembly provides a quiet launch. And inasmuch as only a small shot of pressurized water is required of the disc, a relatively small disc may be utilized.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A missile launch assembly for underwater vehicles, the assembly comprising:

a launch tank capable of having a working fluid therein;

an expandable elastomeric disc mounted in said launch tank;

a turbine mounted in said launch tank;

a water inlet conduit;

a launch tube;

an impulse tank interconnecting said water inlet conduit and said launch tube; and a pump inducer mounted in said water inlet conduit and drivable by said turbine;

wherein movement of said expandable elestomeric disc from an expanded to a non-expanded condition causes the working fluid in said launch tank to drive said turbine to drive said pump inducer to pump water from said water inlet conduit to said impulse tank and thence to said launch tube for effecting launch of an underwater vehicle therein.

2. The missile launch assembly in accordance with claim 1 wherein the disc is fixed at a periphery thereof to an internal wall of said launch tank, said launch tank and the disc defining a chamber in the launch tank for retaining the working fluid and for receiving an expanded portion of the disc.

3. The missile launch assembly in accordance with claim 2 wherein said launch tank includes a neck portion on a side of the disc opposite from the chamber.

4. The missile launch assembly in accordance with claim 3 wherein the neck portion comprises a funnel portion contiguous with the chamber, and a cylindrically-shaped portion which extends outwardly from the funnel portion.

5. The missile launch assembly in accordance with claim 4 wherein said turbine is disposed in the cylindrically-shaped portion of the neck portion, and further comprising a turbine shaft extending through said launch tank and outwardly therefrom.

6. The missile launch assembly in accordance with claim 5 wherein said pump inducer is mounted on said turbine shaft and disposed in said water inlet conduit.

7. The missile launch assembly in accordance with claim 6 and further comprising a charge pump joined between said launch tank chamber and said launch tank neck portion for moving water from the launch tank chamber to the launch tank neck portion.

8. The missile launch assembly in accordance with claim 7 and further comprising a transfer conduit interconnecting an end of the launch tank neck portion and the launch tank chamber for moving water from a downstream end of the turbine to the launch tank chamber.

9. The missile launch assembly in accordance with claim 8 and further comprising a launch valve mounted in said transfer conduit for placing the launch tank neck portion in communication with the launch tank chamber.

10. A launch assembly for underwater vehicles, the assembly comprising:

a launch tank comprising a body portion and a neck portion;

an elastomeric disc fixed at a periphery thereof to an internal wall of the launch tank body portion to define a chamber, the disc being disposed between the launch tank neck portion and the launch tank body portion; a turbine shaft having impeller blades fixed thereon disposed in the launch tank neck portion;

a water inlet conduit in communication with an external water environment;

a launch tube;

an impulse tank in communication with said water inlet conduit and with said launch tube;

a pump inducer mounted on said turbine shaft and disposed in said water inlet conduit;

a charge pump in communication between the launch tank chamber and the launch tank neck portion for pumping water from the launch tank chamber to the launch tank neck portion;

a transfer conduit interconnecting an end of the launch tank neck portion and the launch tank chamber; and a launch valve mounted in said transfer conduit for placing the launch tank neck portion in communication with the launch tank chamber; whereby operation of said charge pump moves water from the launch tank chamber to the launch tank neck portion which expands said elastomeric disc into the launch tank chamber; and whereby operation of said launch valve permits water in the launch tank neck portion to flow through said turbine impeller blades to rotate said pump inducer in said water inlet conduit to pump water into said impulse tank and thence into the launch tube to effect launch of a vehicle therein.

11. The launch assembly in accordance with claim 10 wherein the launch tank neck portion comprises a funnel portion contiguous with walls of the chamber, and a cylindrically-shaped portion extending outwardly from the funnel portion, said turbine impeller blades being disposed in the cylindrically-shaped portion and said turbine shaft extending outwardly from said cylindrically-shaped portion.

12. The launch assembly in accordance with claim 11 and further comprising a charge conduit extending from the launch tank chamber to the launch tank funnel portion, said charge pump being mounted in said charge conduit.

13. The launch assembly in accordance with claim 10 wherein said disc is expandable into the launch tank chamber in a direction away from the launch tank neck portion, and upon release of expanding pressure thereon, is moveable toward said turbine impeller blades.

* * * * *